US006594868B1

(12) United States Patent
Savicki

(10) Patent No.: US 6,594,868 B1
(45) Date of Patent: Jul. 22, 2003

(54) CLOSURE DEVICE

(75) Inventor: Alan F. Savicki, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 09/979,544

(22) PCT Filed: Jun. 10, 1999

(86) PCT No.: PCT/US99/13092

§ 371 (c)(1),
(2), (4) Date: Nov. 14, 2001

(87) PCT Pub. No.: WO00/76338

PCT Pub. Date: Dec. 21, 2000

(51) Int. Cl.[7] ..... A44B 19/16; B65D 33/16

(52) U.S. Cl. ..... 24/30.5 R; 24/30.5 P; 383/65

(58) Field of Search ..... 24/30.5 R, 30.5 P, 24/587, 399, 400, 389, 576; 383/63, 65; 156/66

(56) References Cited

U.S. PATENT DOCUMENTS

| | | | | |
|---|---|---|---|---|
| 1,564,039 A | | 12/1925 | Laguerre | |
| 2,960,561 A | | 11/1960 | Plummer | |
| 3,074,137 A | | 1/1963 | Hawley | |
| 3,103,049 A | | 9/1963 | Hawley | |
| 3,106,941 A | | 10/1963 | Plummer | |
| 3,230,593 A | | 1/1966 | Herz | |
| 3,343,233 A | | 9/1967 | Gould | |
| 3,426,396 A | | 2/1969 | Laguerre | |
| 3,579,747 A | | 5/1971 | Hawley | |
| 3,713,923 A | | 1/1973 | Laguerre | |
| 3,806,998 A | | 4/1974 | Laguerre | |
| 4,199,845 A | | 4/1980 | Ausnit | |
| 4,262,395 A | | 4/1981 | Kosky | |
| 4,513,484 A | * | 4/1985 | Iblings | 24/437 |
| 5,007,142 A | | 4/1991 | Herrington | |
| 5,007,143 A | | 4/1991 | Herrington | |
| 5,010,627 A | | 4/1991 | Herrington | |
| 5,020,194 A | | 6/1991 | Herrington | |
| 5,067,208 A | | 11/1991 | Herrington et al. | |
| 5,070,583 A | | 12/1991 | Herrington | |
| 5,283,932 A | | 2/1994 | Richardson et al. | |
| 5,301,394 A | | 4/1994 | Richardson et al. | |
| 5,426,830 A | | 6/1995 | Richardson et al. | |

(List continued on next page.)

FOREIGN PATENT DOCUMENTS

| | | |
|---|---|---|
| FR | 1564039 | 4/1969 |

*Primary Examiner*—Robert J. Sandy
*Assistant Examiner*—André L. Jackson
(74) *Attorney, Agent, or Firm*—Thomas C. Feix

(57) ABSTRACT

A multi-piece slider member (150) is provided for use with a closure device having interlocking fastening strips (120, 130) disposed along opposing side walls of a storage container, such as a conventional plastic bag. The slider member (150) includes a first housing segment (160), a separate second housing segment (170), and a latching mechanism (200) for use in assembling the first and second housing segments together onto the fastening strips. The latching mechanism (200) includes a first member (210) disposed on the first housing segment and a cooperating second member (240) disposed on the second housing segment. When the first and second housing. segments (150, 160) are moved together during assembly, the second member (240) receives the first member (210) while the first member engages the second member to hold the first and second housing segments together in an assembled position. The slider member (150) also includes an alignment mechanism (270) for aligning the first and second housing segments. The alignment mechanism (270) includes a first pin (272) in the first housing segment and a first cooperating slot (274) in the second housing segment. The first pin (272) engages the first slot (274) when the housing segments are assembled.

96 Claims, 8 Drawing Sheets

U.S. PATENT DOCUMENTS 5,431,760 A 7/1995 Donovan
5,442,837 A 8/1995 Morgan
5,442,838 A 8/1995 Richardson et al.
5,448,808 A 9/1995 Gross
5,664,299 A 9/1997 Porchia et al.
5,722,128 A 3/1998 Toney et al.
5,809,621 A 9/1998 McCree et al.
5,924,173 A 7/1999 Dobreski et al.
5,996,187 A * 12/1999 Tanaka et al. ..... 24/399
6,442,804 B2 * 9/2002 Turvey et al. ..... 24/399

* cited by examiner

CLOSURE DEVICE

FIELD OF THE INVENTION

The present invention relates generally to closure devices and, more particularly, to a closure device having interlocking fastening strips, a slider member comprised of separate first and second housing segments, and a latching mechanism for use in assembling the first and second housing segments together onto the interlocking fastening strips. The inventive closure device may be employed in traditional fastener areas and is particularly well suited for fastening flexible storage containers, such as plastic bags.

BACKGROUND OF THE INVENTION

The use of closure devices for fastening storage containers, including plastic bags, is generally well known. Furthermore, the manufacture of closure devices made of plastic materials is generally well known to those skilled in the art, as demonstrated by the numerous patents in this area.

A particularly well-known-use for closure devices is in connection with flexible storage containers, such as plastic bags. Such closure devices provide a convenient way to close the bag in order to retain matter therein.

Conventional closure devices typically utilize mating fastening strips or closure elements which are used to selectively seal the bag. With such closure devices, however, it is often difficult to determine whether the fastening strips are fully occluded. This problem is particularly acute when the fastening strips are relatively narrow. Accordingly, when such fastening strips are employed, there exists a reasonable likelihood that the closure device is at least partially open.

Such fastening strips are particularly difficult to manipulate or handle by individuals with limited manual dexterity. Thus, in order to assist these individuals and for ease of use by individuals with normal dexterity, the prior art has provided sliders for use in opening and closing the fastening strips, as disclosed, for example, in U.S. Pat. Nos. 4,199,845, 5,007,142, 5,007,143, 5,010,627, 5,020,194, 5,070,583, 5,283,932, 5,301,394, 5,426,830, 5,431,760, 5,442,838, and 5,448,808. Some of these sliders include a separator finger which extends at least partially between the fastening strips. When the slider is moved in the appropriate direction, the separator finger divides the fastening strips and opens and the bag.

While the use of a slider certainly facilitates the opening and closing of fastening strips, there are certain difficulties involved with installing and assembling the slider onto the fastening strips and with retaining the slider thereon. In an attempt to rectify some of these difficulties, the prior art has provided a variety of slider designs including various multi-piece sliders, as disclosed, for example, in U.S. Pat. Nos. 5,007,142, 5,283,932, and 5,426,830. These multi-piece sliders suffer from deficiencies including, for example, a relatively complex construction, a high relative cost, and a relatively difficult installation upon and assembly onto the fastening strips.

OBJECTS OF THE INVENTION

Accordingly, a general object of the present invention is to provide a slider member for closure devices which overcomes the deficiencies of the prior art.

A more specific object of the present invention is to provide a multi-piece slider member for closure devices which is easily installed upon and assembled onto interlocking fastening strips.

A further object of the present invention is to provide a-multi-piece slider member for closure devices which is formed of separate housing segments and includes a latching mechanism for use in assembling these housing segments together upon interlocking fastening strips.

Another object of the present invention is to provide a multi-piece slider member as characterized above which is convenient to use.

An additional object of the present invention is to provide a multi-piece slider member of the foregoing type which is relatively simple and economical in construction, and which lends itself to reliable operation sold use.

SUMMARY OF THE INVENTION

Accordingly, a multi-piece slider member is provided for use with a closure device having interlocking fastening strips disposed along opposing side walls of a storage container, such as a conventional plastic bag. The slider member comprises a first housing segment, a separate second housing segment, and a latching mechanism for use in assembling the first and second housing segments together onto the fastening strips. The latching mechanism includes a first member disposed on the first housing segment and a cooperating second member disposed on the second housing segment. The first and second members of the latching mechanism each have a shoulder with an edge portion. When the first and second housing segments are moved together during assembly, the second member of the latching mechanism receives the first member of the latching mechanism while the edge portion of the first member engages the edge portion of the second member to hold the first and second housing segments together in an assembled position.

These and other objects, features, and advantages of the present invention will become more readily apparent upon reading the following detailed description of the illustrated embodiments and upon reference to the accompanying drawings wherein:

Figure 1:
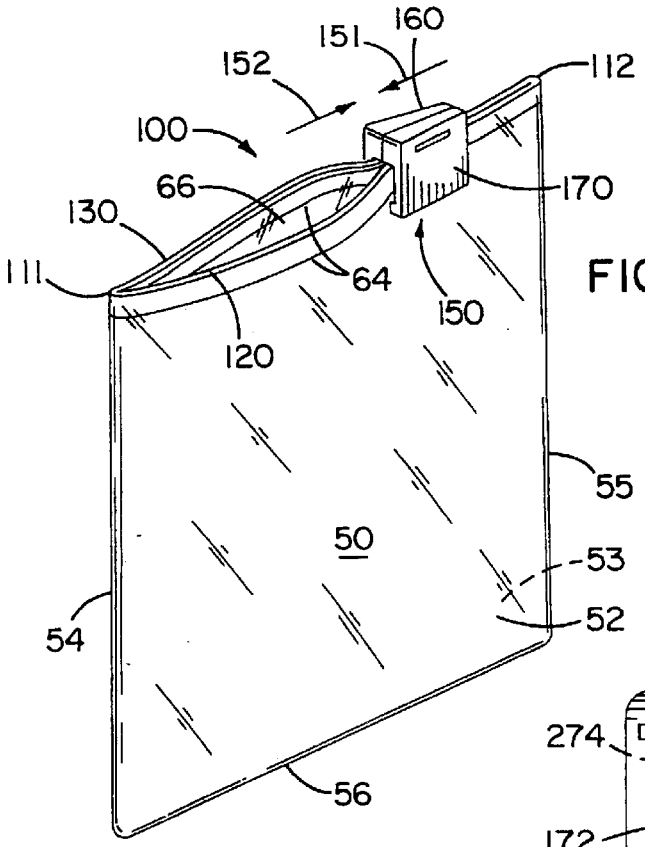
FIG. 1 is a perspective view of a storage container in the form of a plastic bag utilizing a closure device comprised of interlocking fastening strips and a slider member constructed in accordance with the present invention.

While the present invention is susceptible to various modifications and alternative constructions, certain illustrated embodiments thereof have been shown in the drawings and will be described in detail below. It should be understood, however, that there is no intention to limit the present invention to the disclosed structural forms. On the contrary, the intention is to cover all modifications, alternative constructions, and equivalents that fall within the spirit and scope of the present invention as defined by the appended claims.

DETAIL DESCRIPTION OF THE ILLUSTRATED EMBODIMENTS

Turning now to the drawings, a closure device constructed in accordance with the present invention is generally designated by reference numeral 100. As best shown in FIG. 1, the closure device 100 is intended for use with a storage container 50, such as a conventional plastic bag, which includes a pair of complementary sheets or opposing flexible side walls 52, 53 attached at lateral sides 54, 55 and bottom 56 to form a storage compartment. The side walls 52, 53 are also unattached at upper edge portions 64 to form a mouth 66 for the storage container 50. Although a rectangularly-shaped storage container or bag 50 is specifically illustrated herein, it will be readily appreciated by those skilled in the art that other configurations may alternatively be employed without departing from the scope or spirit of the present invention.

As shown in FIG. 1, the closure device 100 includes a pair of interlocking fastening strips 120, 130 which are disposed along the upper edge portions 64 of the opposing side walls 52, 53. The closure device 100 also includes a slider member 150 which is slidably carried by the two fastening strips 120, 130. More specifically, the first fastening strip 120 is attached to the upper edge portion 64 of the side walls 52, the second fastening strip 130 is attached to the upper edge portion 64 of the other side wall 53, and the inventive slider member 150 slidably straddles the first and second fastening strips 120 and 130.

As will be described in greater detail below, the interlocking fastening strips 120, 130 may be of virtually any type, kind, version, or form including, for example: (1) shear action or Z-axis fastening strips as shown herein at FIGS. 4–7, 10, and 13–16; (2) U-channel fastening strips as shown herein at FIG. 17; (3) arrowhead-type fastening strips, as disclosed in U.S. Pat. Nos. 3,198,228 (which reissued as Re. 28,969), 4,736,496, and 5,363,540 and as shown herein at FIG. 18; (4) rolling action fastening strips, as disclosed in U.S. Pat. No. 5,007,143 and as shown herein at FIG. 19; and/or (5) profile fastening strips, as disclosed in U.S. Pat. No. 5,664,299 and as shown herein at FIG. 20. While the interlocking fastening strips 120, 130 depicted in FIGS. 4–7, 10, and 13–16 are of the shear action or Z-axis variety, it will be readily appreciated by those a skilled in the art that these fastening strips were selected for illustrative purpose only and that any other variety of interlocking fastening strips may alternatively be used, including those shown in FIGS. 17–20, without departing from the scope of spirit of the present invention. In addition, all of the above-identified patents and applications are hereby incorporated by reference in their entireties.

In operation, the slider member 150 facilitates the occlusion and deocclusion of the interlocking fastening strips 120, 130 when moved in the appropriate direction along the fastening strips. In particular, the slider member 150 facilitates the occlusion of the fastening strips 120, 130 when moved towards a first end 111 thereof, and facilitates the deocclusion of the fastening strips when moved towards a second end 112 thereof. In other words, when the slider 150 is moved in an occlusion direction, as indicated by reference numeral 151 in FIGS. 1, 2, and 11, it facilitates the closure of the fastening strips, and when the slider 150 is moved in a deocclusion direction, as indicated by reference numeral 152, it facilitates the separation of the fastening strips. The first and second ends 111 and 112 of the interlocking fastening strips correspond to, and are aligned with, the two lateral sides 54, 55 of the complementary sheets or opposing side walls 52.

The slider member 150 of the present invention comprises separate first and second housing segments 160 and 170 which have substantially complementary configurations and are formed from separate pieces of suitable plastic material. The first housing segment 160 includes a top portion 162 with a face 163, a bottom portion 164 with a shoulder 165, and an intermediate side portion 166 arranged between the top and bottom portions 162 and 164. Likewise, the second housing segment 170 includes a top portion 172 with a face 173, a bottom portion 174 with a shoulder 175, and an intermediate side portion 176 arranged between the top and bottom portions 172 and 174.

Figure 18:
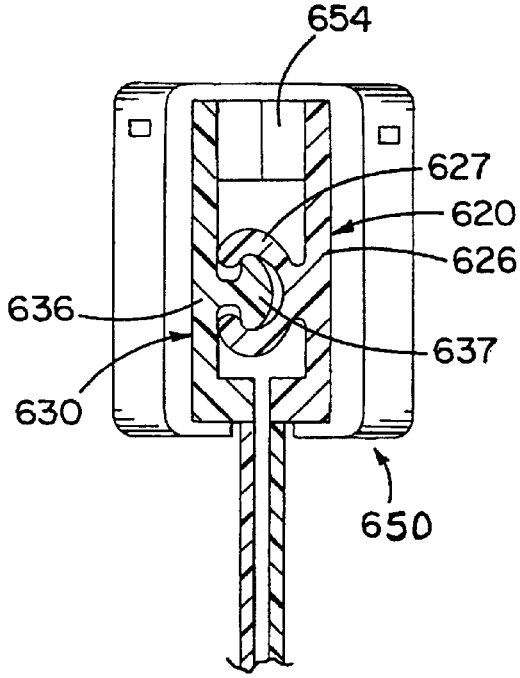
FIG. 18 is a cross-sectional view taken along line 18—18 in FIG. 2, but showing a third embodiment of the interlocking fastening strips.
Figure 19:
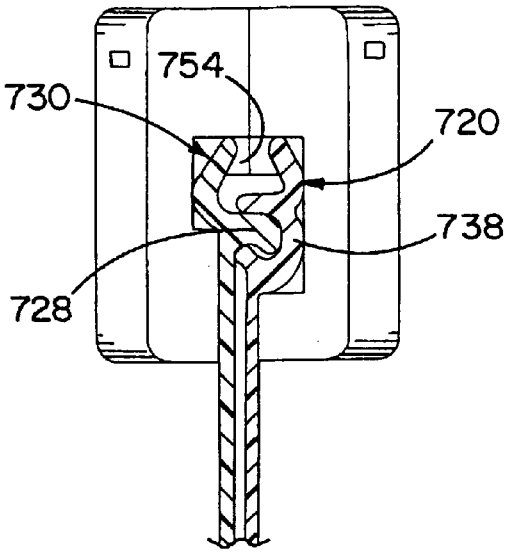
FIG. 19 is a cross-sectional view taken along line 19—19 in FIG. 2, but showing a fourth embodiment of the interlocking fastening strips.

As will be readily appreciated by those skilled in the art, the slider member 150 may be provided with a separator finger or other structure which extends downwardly from one or both of the top portions 162 and 172 of the first and second housing segments 160 and 170, as shown, for example, in FIGS. 18 and 19, and into an internal void between the side portions 166 and 176 of the two housing segments 160 and 170. In use, this separator finger provides for the separation of the interlocking fastening strips when the slider member is moved in the deocclusion direction, as disclosed, for example, in U.S. Pat. Nos. 5,007,142, 5,007,143, 5,010,627, 5,020,194, 5,067,208, 5,070,583, 5,188,971, 5,131,121, 5,161,286, 5,189,764, 5,282,932, 5,301,395, 5,426,830, 5,448,808, and 5,442,837.

In accordance with an important aspect of the present invention, the two housing segments of the slider member are also provided with a latching mechanism which facilitates their installation upon and assembly onto the interlocking fastening strips of the closure device. As will be described in greater detail below, two embodiments of the inventive latching mechanism are illustrated herein at FIGS. 2–10 and 11–16, respectively. Each embodiment of the latching mechanism will now be addressed in turn.

As shown in FIGS. 2–10, the first embodiment of the inventive latching mechanism 200 comprises a first member 210 disposed on the first housing segment 160 and a cooperating second member 240 disposed on the second housing segment 170. More specifically, the first member 210 of the latching mechanism 200 has a generally planar configuration and projects outwardly from the face 163 of the first housing segment 160. The second member 240 of the latching mechanism 200 has a generally planar configuration and projects outwardly from the face 173 of the second housing segment 170. The first member 210 of the latching mechanism 200 is also substantially parallel to, but slightly offset from, the second member 240 of the latching mechanism 200. On account of this construction, the second member 240 of the latching mechanism 200 is positioned to receive and engage the first member 210 of the latching mechanism 200 in a partially overlapping manner when the first and second housing segments 160 and 170 are moved together, as depicted, for example, in FIGS. 4 and 6.

Although other constructions are permissible and would certainly fall within the scope and spirit of the present invention, those skilled in the art will readily appreciate that forming the first member 210 of the latching mechanism 200 and the first housing segment 160 of the slider member 150 of unitary construction provides many advantages. Those skilled in the art will also appreciate that forming the second member 240 of the latching mechanism 200 and the second housing segment 170 of the slider member 150 of unitary construction provides similar advantages.

Figure 4:
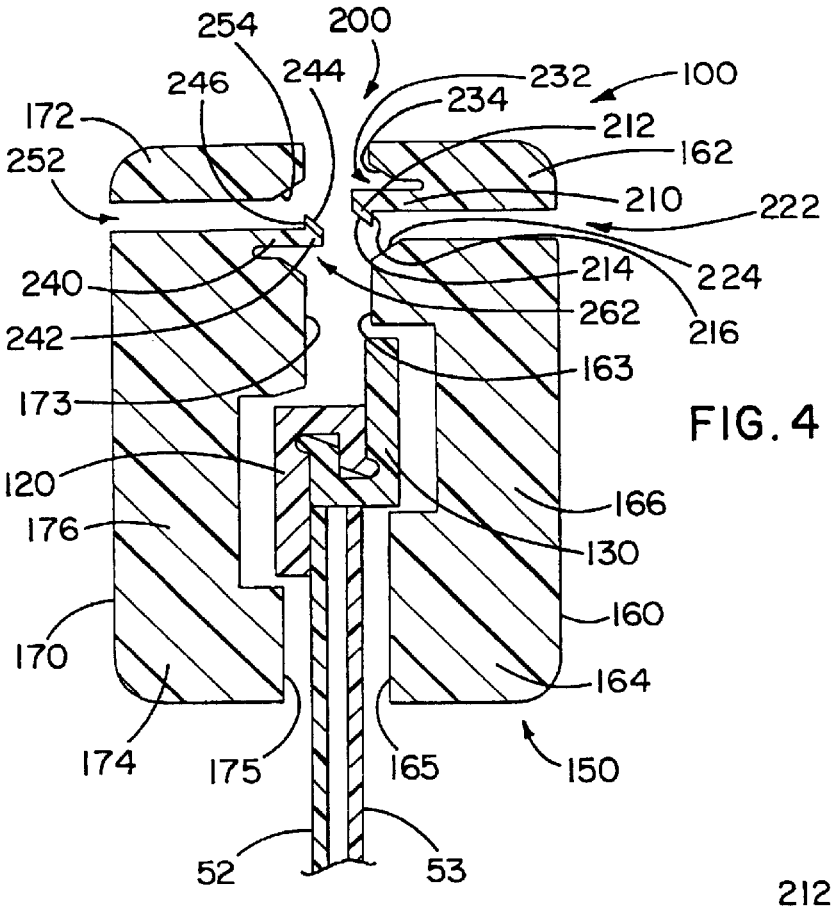
FIG. 4 is an enlarged cross-sectional view taken along line 4—4 of FIG. 2, but showing the two housing segments of the slider member in the unassembled position.

In order to provide a desired resiliency to the first member 210 of the latching mechanism 200 and a suitable receiving gap for the second member 240 of the latching mechanism 200 when the first and second housing segments 160 and 170 are assembled together, a pair of apertures 222 and 232 are formed on opposite sides of the first member 210. As best shown in FIG. 4, the first aperture 222 extends completely through the top portion 162 of the first housing segment 160 and the second aperture 232 extends only partially through the top portion 162 of the first housing segment 160. In this way, the first and second apertures 222 and 232 are each adjacent to the first member 210, but project inwardly from the face 163 of the top portion 162 to different depths. Each aperture 222 and 232 also includes a chamfer 224 and 234 at the face 163 of the top portion 162.

The second member 240 of the latching mechanism 200 also includes a pair of apertures 252 and 262 formed on opposite sides thereof which provides a desired resiliency to the second member 240 and a receiving gap for the first member 210 when the first and second housing segments 160 and 170 are assembled together. More specifically, the first aperture 252 is adjacent to the second member 240 and extends completely through the top portion 172 of the second housing segment 170. The second aperture 262 is adjacent to the second member 240, but extends only partially through the top portion 172 of the second housing segment 170. Each aperture 252 and 262 also projects inwardly from the face 173 of the top portion 172 and includes a chamfer 254 and 264.

While the four apertures 222, 232, 252, and 262 of the latching mechanism 200 are shown extending to given depths, it will be readily appreciated by those skilled in the art that these apertures 222, 232, 252, and 262 may, of course, extend to virtually any depth and be of any number, provided that there is sufficient room for the first and second members 210 and 240 when the first and second housing segments 160 and 170 are assembled together. In alternative embodiments, for example the first apertures, 222 and 252 of the latching mechanism 200 may extend only partially through the top portions 162 and 172 of the first and second housing segments 160 and 170, respectively, without departing from the scope or spirit of the present invention. Aside from the depth of these apertures 222, 232, 252, and 262, the relative thickness and the material properties of the first and second members 210 and 240 are also factors which influence and/or contribute to the resiliency of the first and second members 210 and 240.

Figure 6:
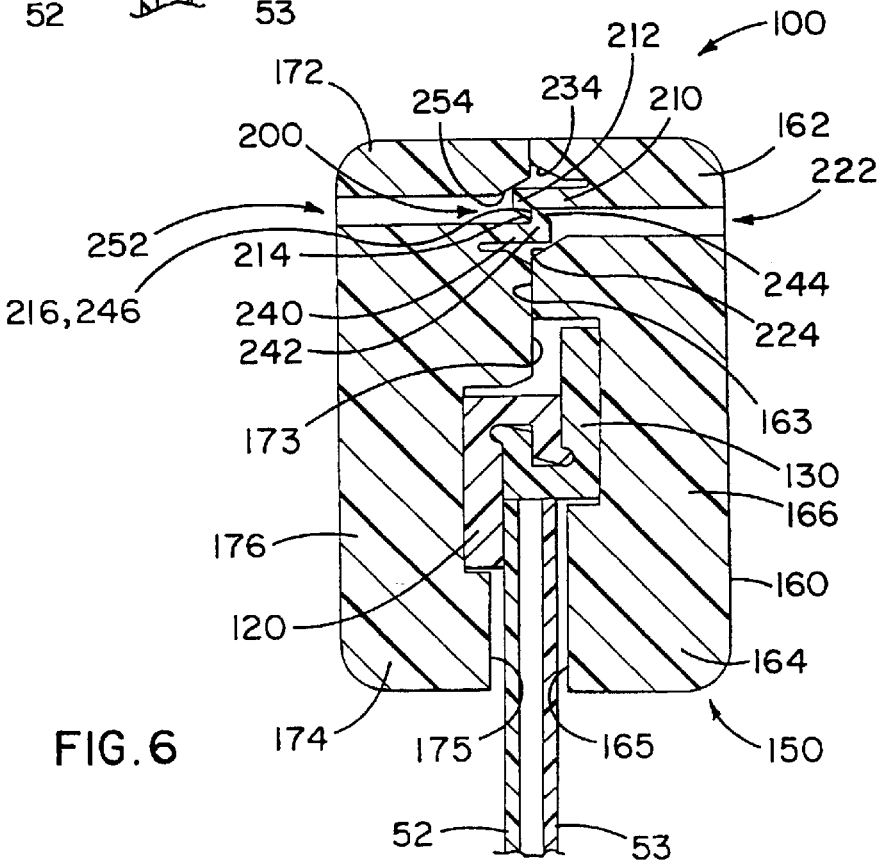
FIG. 6 is an enlarged cross-sectional view taken along line 6—6 of FIG. 2.

As best shown in FIGS. 4 and 6, the first and second members 210 and 240 of the inventive latching mechanism 200 each include a shoulder 212 and 242 at their respective distal ends which, as described in greater detail below, cooperate to retain the first and second housing segments 160 and 170 together. In the illustrated embodiment, the shoulders 212 and 242 of the first and second members 210 and 240 each have a generally right-triangular configuration. In particular, the shoulder 212 of the first member 210 includes an inclined camming surface 214 which advances toward the chamfer 224 of aperture 222 in an outwardly sloping manner and an edge portion 216 which transitions back toward the longitudinal axis of the first member 210 in a substantially perpendicular manner. Similarly, the shoulder 242 of the second member 240 includes an inclined camming surface 244 which advances toward the chamfer 254 of aperture 252 in an outwardly sloping manner and an edge portion 246 which transitions back toward the longitudinal axis of the second member 240 in a substantially perpendicular manner. In this way, the shoulder 212 of the first member 210 projects away from the chamfer 234 of aperture 232 while the shoulder 242 of the second member 240 projects away from the chamfer 264 of aperture 262. In addition, when the first and second housing segments 160 and 170 are positioned for prospective assembly, as shown, for example, in FIG. 4, the shoulder 212 of the first member 210 projects at least partially toward the shoulder 242 of the second member 240.

In order to facilitate proper alignment between the first and second housing segments 160 and 170 during their assembly upon the interlocking fastening strips 120, 130, a convenient alignment mechanism 270 is also provided on the first and second housing segments 160 and 170. In the illustrated embodiment, the alignment mechanism 270 comprises a pair of spaced-apart alignment pins 272 projecting outwardly from the top portion 162 of the first housing segment 160 and a pair of cooperating slots 274 formed in the top portion 172 of the second housing segment 170. More specifically, the pins 272, of the alignment mechanism 270 project outwardly from the face 163 of top portion 162 and are disposed on opposite sides of the first member 210. The slots 274 of the alignment mechanism 270 project inwardly from the face 173 of top portion 172 and are disposed on opposite sides of the second member 240. The slots 274 of the alignment mechanism 270 are also substantially aligned with the pins 272 of the alignment mechanism 270. Thus, when the first and second housing segments 160 and 170 are moved together during assembly, the slots 274 of the alignment mechanism 270 receive the pins 272 of the alignment mechanism 270 to provide proper alignment between the first and second housing segments, 160 and 170. The alignment mechanism 270 also protects against the inadvertent detachment or separation of the first and second housing segments 160 and 170 when opposed lateral shearing forces are applied to the first and second housing segments 160 and 170 in directions substantially equivalent to the occlusion and deocclusion directions 151 and 152.

While the pins 272 of the alignment mechanism 270 are shown projecting from the top portion 162 of the first housing segment 160 and the slots 274 of the alignment mechanism 270 are shown extending into the top portion 172 of the second housing segment 170, it will be readily appreciated by those skilled in the art that the relative location of the pins 272 and slots 274 may be reversed so that the pins 272 project from the top portion 172 of the second housing segment 170 and the slots 274 extend into the top portion 162 of the first housing segment 160. In addition, the alignment mechanism 270 may be provided with virtually any number of pins 272 and slots 274 without departing from the scope or spirit of the present invention.

Figure 3:
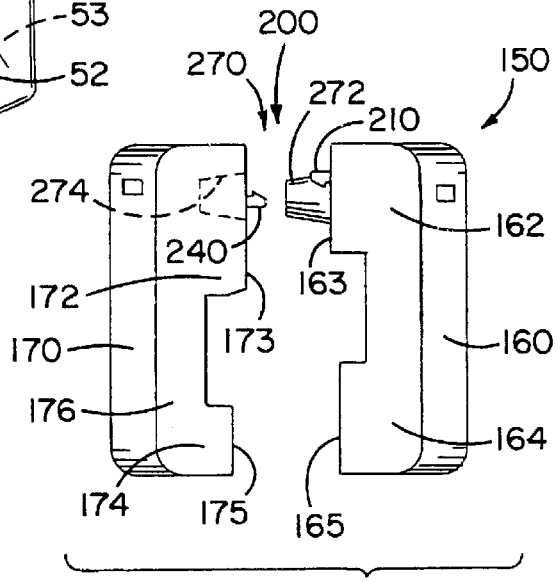
FIG. 3 is a rear end view as seen in the direction of line 3—3 of FIG. 2, but showing the interlocking fastening strips removed for clarity and the two housing segments of the slider member in an unassembled position.
Figure 2:
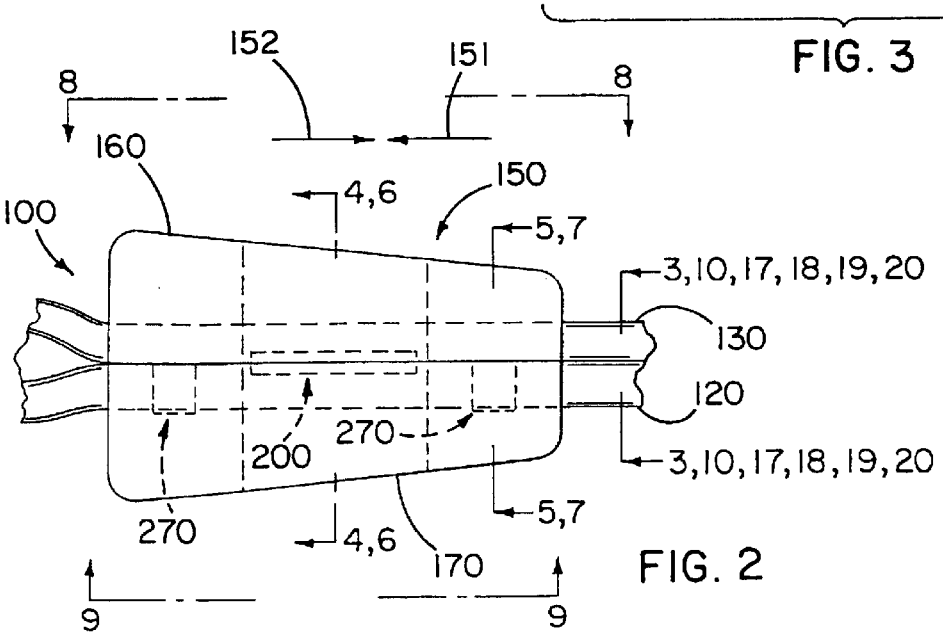
FIG. 2 is an enlarged, partially fragmentary, top plan view of the closure device depicted in FIG. 1, showing the two housing segments of the slider member in an assembled position upon the interlocking fastening strips and a first embodiment of a latching mechanism for use in assembling the two housing segments together.
Figure 5:
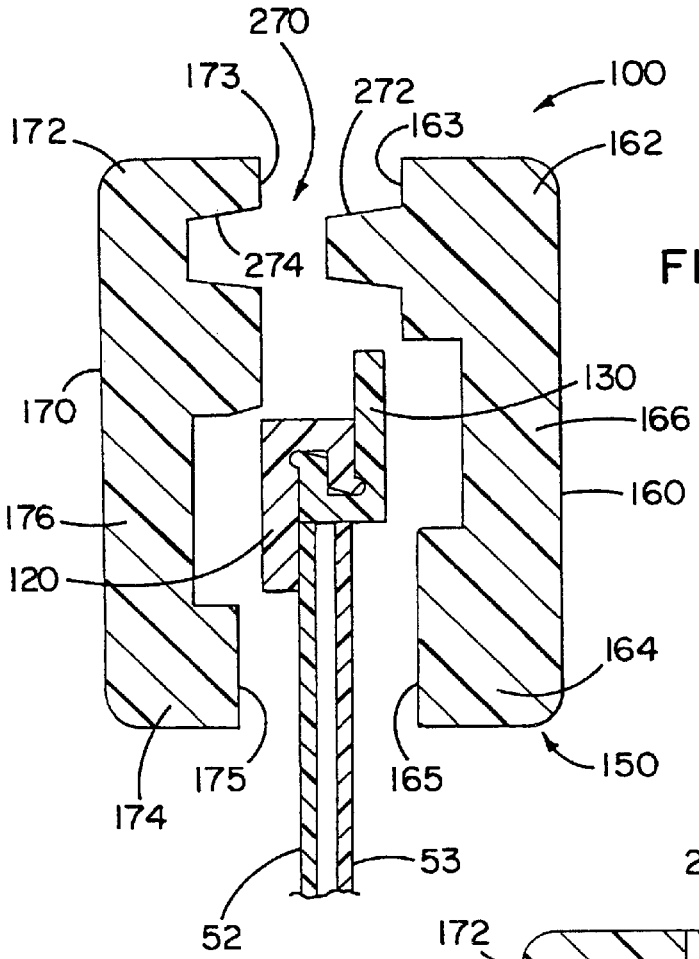
FIG. 5 is an enlarged cross-sectional view taken along line 5 of FIG. 2, but showing the two housing segments of the slider member in the unassembled position and showing an alignment mechanism for use in aligning the two housing segments during their assembly.
Figure 7:
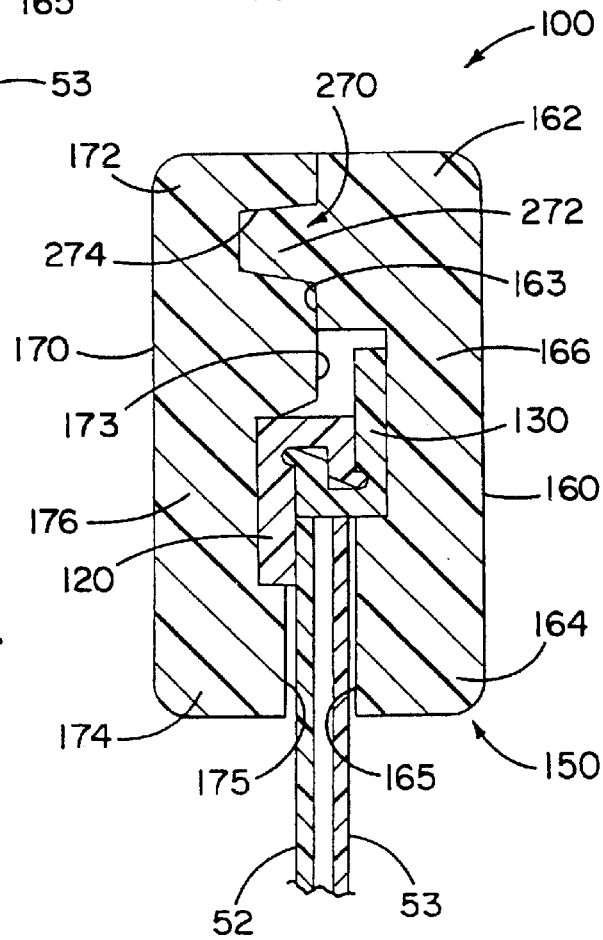
FIG. 7 is an enlarged cross-sectional view taken along line 7—7 of FIG. 2.
Figure 8:
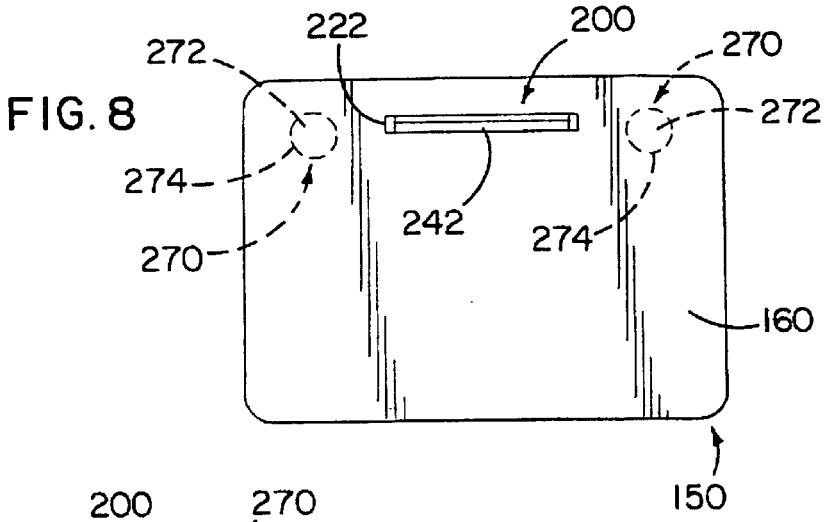
FIG. 8 is a side elevational view as seen in the direction of line 8—8 of FIG. 2, but showing the interlocking fastening strips removed for clarity.
Figure 9:
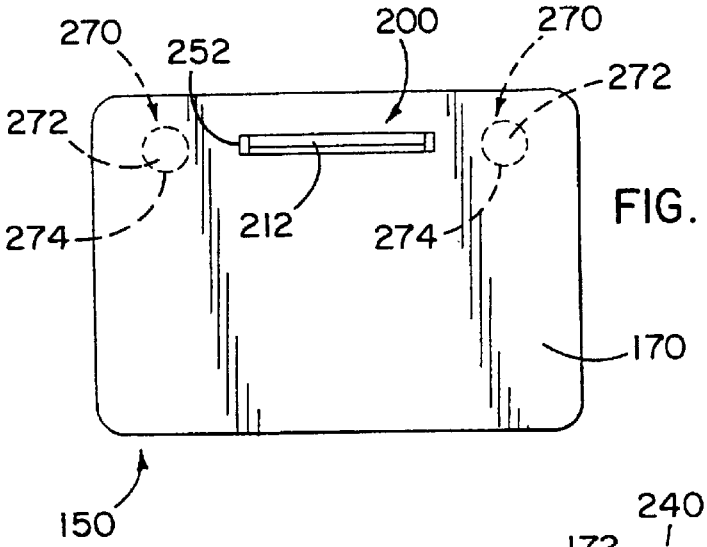
FIG. 9 is a side elevational view as seen in the direction of line 9—9 of FIG. 2, but showing the interlocking fastening strips removed for clarity.
Figure 10:
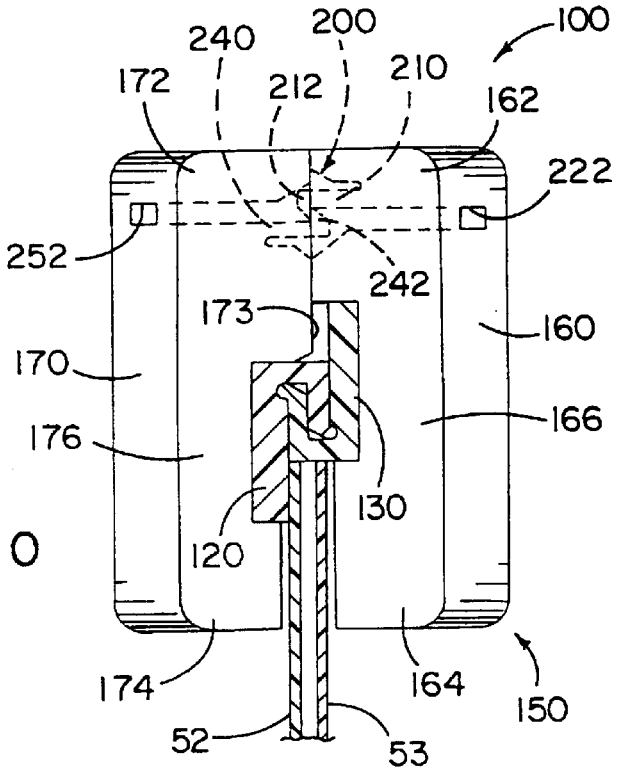
FIG. 10 is a rear end view as seen in the direction of line 10—10 of FIG. 2.

During assembly, the first and second housing segments 160 and 170 are initially moved into an unassembled position, as shown in FIGS. 3, 4, and 5. In the unassembled position, the first housing segment 160 is spaced-apart from, but substantially aligned with, the second housing segment 170. Next, the alignment pins 272 of the alignment mechanism 270 are moved into engagement with the slots 274 of the alignment mechanism 270. Opposing forces are then applied to the first and second housing segments 160 and 170 to move these two housing segments into an assembled position, as shown in FIGS. 2, 6, and 7. As the first and second housing segments 160 and 170 are moved toward the assembled position, the alignment mechanism 270 keeps the first and second housing segments 160 and 170 in proper alignment while the inclined camming surface 214 of the first member 210 engages the inclined camming surface 244 of the second member 240 which causes the first and second members 210 and 240 to flex slightly apart. Once the first and second housing segments 160 and 170 arrive at the assembled position, the first and second members 210 and 240 of the latching mechanism 200 flex back to the position shown in FIG. 6 while the edge portion 216 of the first member 210 engages the edge portion 246 of the second member 240 to provide a convenient snap-fit interface between the first and second housing segments 160 and 170.

In the assembled position as shown in FIG. 6, the face 163 of the first lousing segment 160 is held firmly against the face 173 of the second housing segment 170 by this engagement between the edge portion 216 of the first member 210 and the edge portion 246 of the second member 240. In addition, the shoulder 212 of the first member 210 is received by the first aperture 252 formed in the top portion 172 of the second housing segment 170 while the shoulder 242 of the second member 240 is received by the first aperture 222 formed in the top portion 162 of the first housing segment 160. The shoulders 212 and 242 of the first and second members 210 and 240 are also proximate to chamfers 254 and 224, respectively.

A second embodiment of the inventive latching mechanism 400 is shown in FIGS. 11–16. In this embodiment, the latching mechanism 400 comprises a first member 410 projecting from the first housing segment 360 and a cooperating second member 440 disposed on the second housing segment 370. More specifically, the first member 410 of the latching mechanism 400 has a generally planar configuration and projects outwardly from the face 363 of the first housing segment 360. The second member 440 of the latching mechanism 400 forms a part of the second housing segment 370 and projects inwardly from the face 373 thereof. The first member 410 of the latching mechanism is also substantially parallel to, but offset from, the second member 440 of the latching mechanism. On account of this construction, the second member 440 of the latching mechanism is positioned to receive and engage the first member 410 of the latching mechanism in a partially overlapping manner when the first and second housing segments 360 and 370 are moved together, as depicted, for example, in FIGS. 13 and 15.

While other constructions are certainly permissible, those skilled in the art will readily appreciate that forming the first member 410 of the latching mechanism 400 and the first housing segment 360 of the slider member 350 of unitary construction provides clear advantages. Likewise, those skilled in the art will also appreciate that forming the second member 440 of the latching mechanism 400 and the second housing segment 370 of the slider member 350 of unitary construction provides similar advantages.

Figure 13:
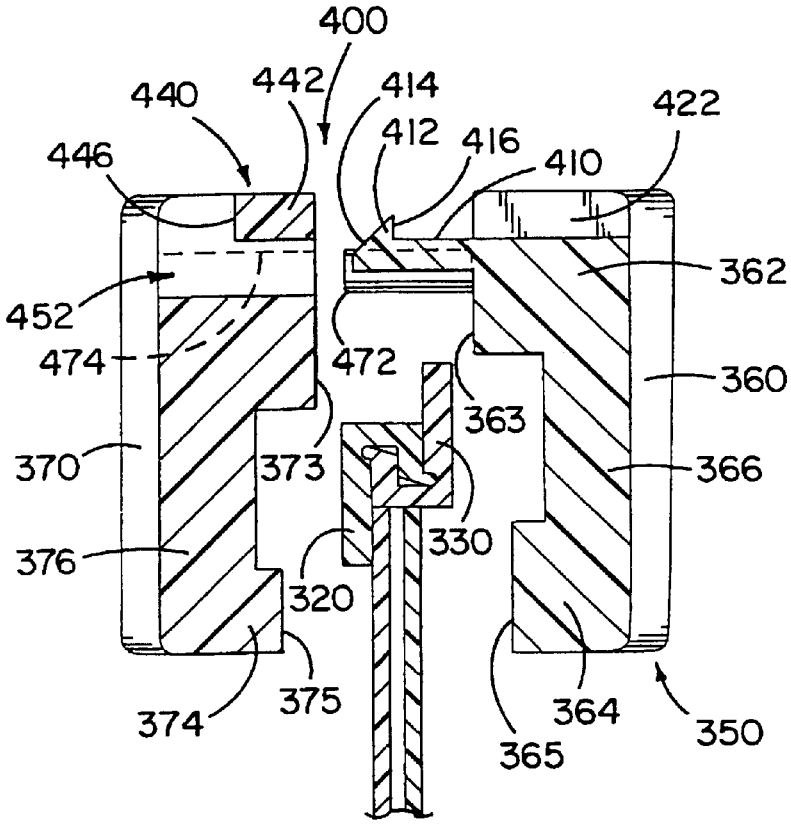
FIG. 13 is a cross-sectional view taken along line 13—13 of FIG. 11, but showing the two housing segments of the slider member in the unassembled position to better depict the second embodiment of the latching mechanism.

In order to provide a suitable receiving gap for the first member 410 of the latching mechanism 400 when the first and second housing segments 360 and 370 are assembled together, a single aperture 452 is formed within the top portion 372 of the second housing segment 370. A single aperture 422 is also formed within the top portion 362 of the first housing segment 360. As best shown in FIG. 13, aperture 422 is substantially straight and extends completely through the top portion 362 of the first housing segment 360. The aperture 452 is generally L-shaped and extends completely through the top portion 372 of the second housing segment 370. In addition, aperture 422 is adjacent to the first member 410 and projects inwardly from the face 363 of top portion 362. The aperture 452 is adjacent to the second member 440 and projects inwardly from the face 373 of top portion 372. In this embodiment, the second member 440 is substantially more rigid than the first member 410. Also, the resiliency of the first member 410 is determined primarily by the relative thickness and the material properties thereof.

Figure 15:
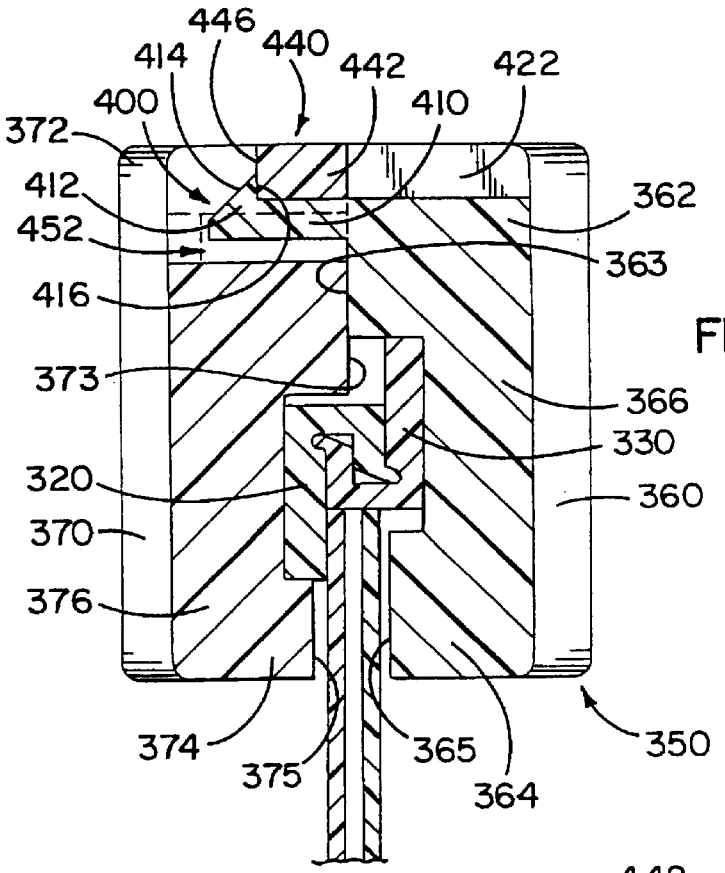
FIG. 15 is a cross-sectional view taken along line 15—15 of FIG. 11.

While the two apertures 422 and 452 of the first and second members 410 and 440 are shown extending completely through the top portions 362 and 372 of the first and second housing segments 360 and 370, it will be readily appreciated by those skilled in the art that these apertures 422 and 452 may extend to virtually any depth and be of virtually any number, provided that there is sufficient room for the first member 410 when the first and second housing segments 360 and 370 are assembled together. In alternative embodiments, for example, aperture 452 may extend only partially through the top portion 372 of the second housing segment 370 without departing from the scope or spirit of the present invention.

as best shown in FIGS. 13 and 15, the first member 410 of the latching mechanism 400 includes a shoulder 412 at its distal end. The second member 440 of the latching mechanism 400 includes a shoulder 442 which is disposed adjacent to aperture 452. As will be described more fully below, the shoulder 412 of the first member 410 cooperates with the shoulder 442 of the second member 440 to retain the first and second housing segments 360 and 370 together. In the illustrated embodiment, the shoulder 412 of the first member 410 has a generally right-triangular configuration. More specifically, this shoulder 412 includes an inclined camming surface 414 which advances toward the top portion 362 of the second housing segment 360 in an outwardly sloping manner. In addition, the shoulder 412 includes an edge portion 416 which transitions back toward the longitudinal axis of the first member 410 in a substantially perpendicular manner. The shoulder 442 of the second member 440 includes an edge portion 446 which extends vertically downwardly from the top surface of the second housing segment 370 into aperture 452.

In order to facilitate proper alignment between the first and second housing segments 360 and 370 during their assembly upon the interlocking fastening strips 320, 330, an alignment mechanism 470 is also provided on the first and second housing segments 360 and 370. In the illustrated embodiment, the alignment mechanism 470 comprises a pair of spaced-apart alignment pins 472 projecting outwardly from the top portion 362 of the first housing segment 360 and a pair of cooperating slots 474 formed through the top portion 372 of the second housing segment 370. More specifically, the pins 472 of the alignment mechanism 470 project outwardly from the face 363 of top portion 362 and are disposed on opposite sides of the first member 410. The slots 474 of the alignment mechanism 470 project inwardly from the face 373 of top portion 372 and are disposed on opposite sides of the second member 440. The slots 474 of the alignment mechanism 470 are substantially aligned with the pins 472 of the alignment mechanism 470. Thus, when the first and second housing segments 360 and 370 are moved together during assembly, the slots 474 of the alignment mechanism 470 receive the pins 472 of the alignment mechanism 470 to provide proper alignment between the first and second housing segments. The alignment mechanism 470 also protects against the inadvertent detachment or separation of the first and second housing segments 360 and 370 when opposed lateral shearing forces are applied to the first and second housing segments 360 and 370 in directions substantially equivalent to the occlusion and deocclusion directions 351 and 352.

While the pins 472 of the alignment mechanism 470 are shown projecting from the top portion 362 of the first housing segment 360 and the slots 474 of the alignment mechanism 470 are shown extending through the top portion 372 of the second housing segment 370, it will be readily appreciated by those skilled in the art that the relative location of the pins 472 and slots 474 may be reversed so that the pins 472 project from the top portion 372 of the second housing segment and the slots 474 extend into the top portion 362 of the first housing segment. In addition, the alignment mechanism 470 may be provided with virtually any number of pins 472 and slots 474 without departing from the scope or spirit of the present invention.

Figure 11:
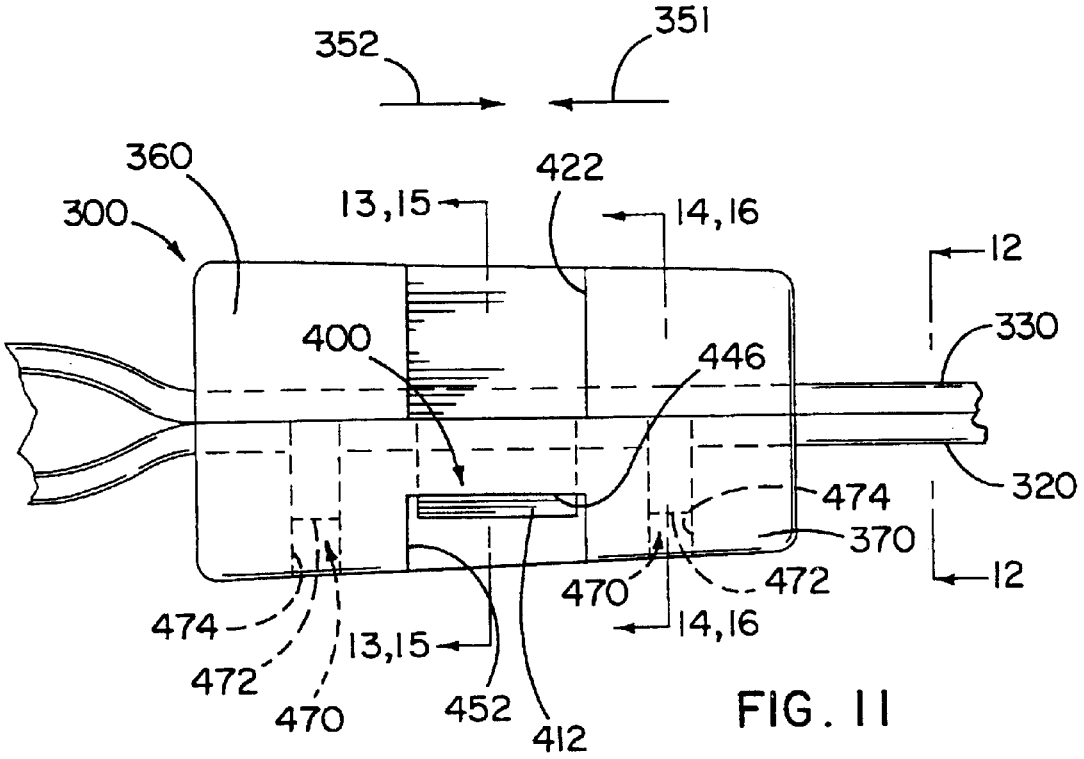
FIG. 11 is a partially fragmentary, top plan view of another embodiment showing the two housing segments of the slider member in an assembled position upon the interlocking fastening strips and showing a second embodiment of the latching mechanism.
Figure 12:
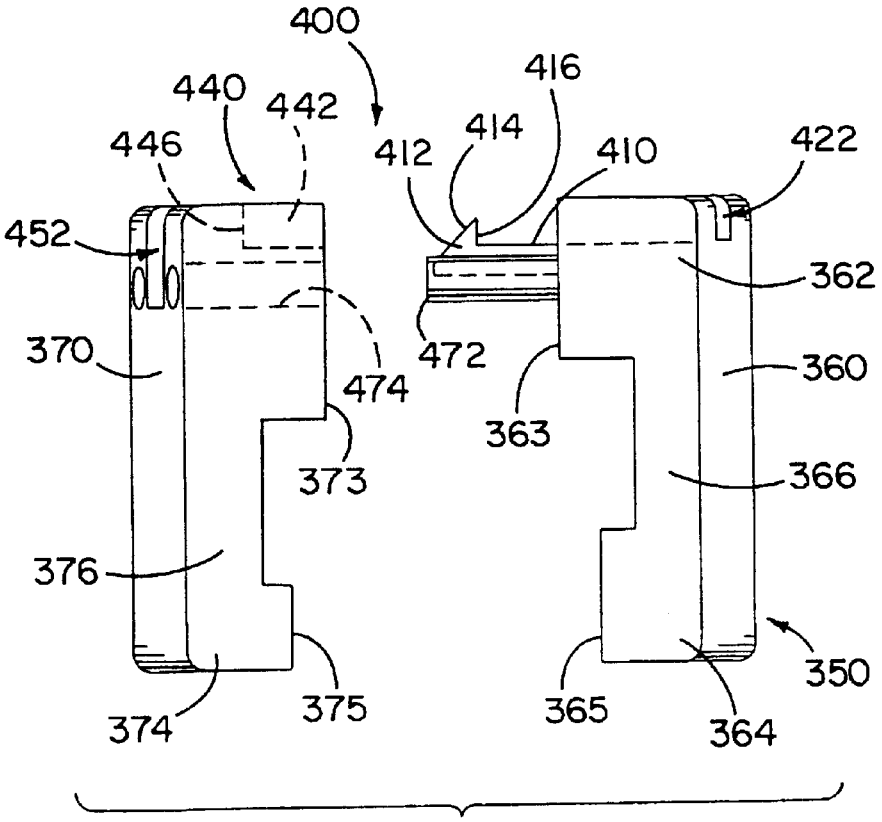
FIG. 12 is a rear end view as seen in the direction of line 12—12 of FIG. 11, but showing the interlocking fastening strips removed for clarity and the two housing segments of the slider member in an unassembled position.
Figure 14:
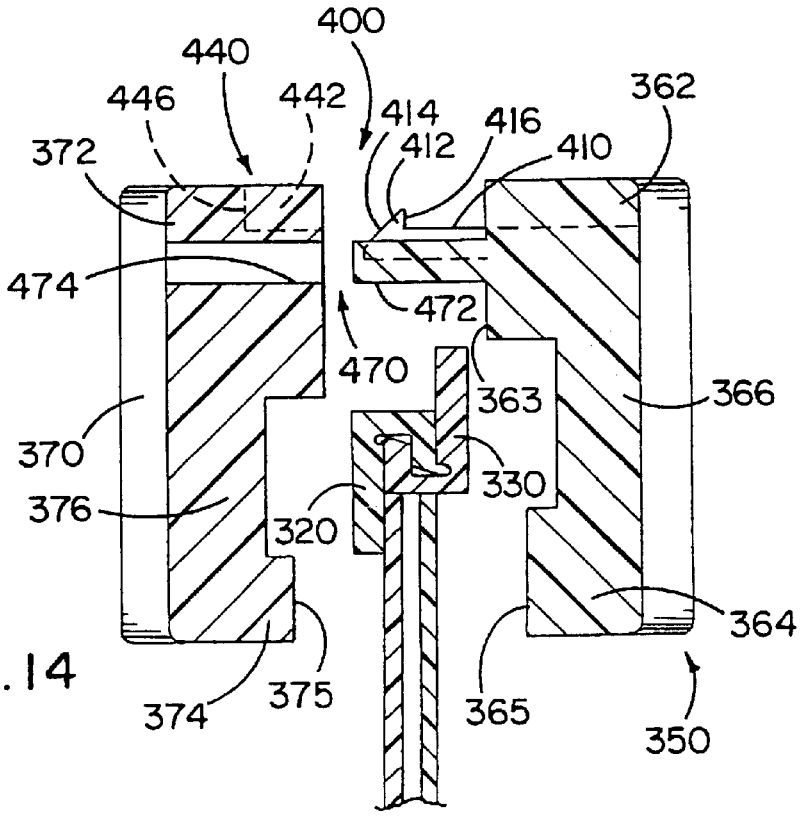
FIG. 14 is a cross-sectional view taken along line 14—14 of FIG. 11, but showing the two housing segments of the slider member in the unassembled position and showing an alignment mechanism for use in aligning the two housing segments during their assembly.
Figure 16:
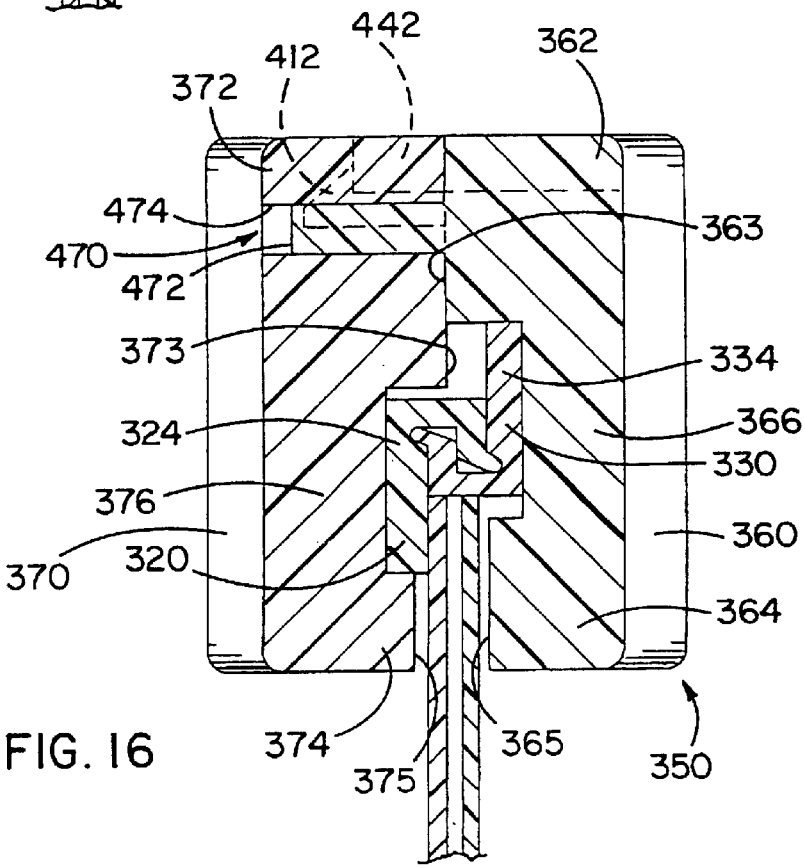
FIG. 16 is a cross-sectional view taken along line 16—16 of FIG. 11.

During assembly, the first and second housing segments 360 and 370 are initially moved into an unassembled position, as shown in FIGS. 12–14. In the unassembled position, the first housing segment 360 is spaced-apart from, but substantially aligned with, the second housing segment 370. Next, the alignment pins 472 of the alignment mechanism 470 are moved into engagement with the slots 474 of the alignment mechanism. Opposing forces are then applied to the first and second housing segments 360 and 370 to move these two housing segments into an assembled position, as shown in FIGS. 11, 15, and 16. As the first and second housing segments 360 and 370 are moved toward the assembled position, the alignment mechanism 470 keeps the first and second housing segments 360 and 370 in proper alignment. The inclined camming surface 414 of the first member 410 engages the shoulder 442 of the second member 440 which causes the shoulder 412 of the first member 410 to flex downwardly into aperture 452.

Once the first and second housing segments 360 and 370 arrive at the assembled position, the first member 410 of the latching mechanism 400 flexes back to the position shown in FIG. 15. The edge portion 416 of the first member 410 engages the edge portion 446 of the second member 440 to provide a convenient snap-fit interface between the first and second housing segments 360 and 370. In the assembled position, the face 362 of the first housing segment 360 is held firmly against the face 372 of the second housing segment 370 by this engagement between the edge portion 416 of the first member 410 and the edge portion 446 of the second member 440. Also, the first member 410 is fully received by aperture 452 and abuts the shoulder 442 of the second member 440, as shown in FIG. 15.

While two embodiments of the inventive latching mechanism have been specifically described and illustrated herein, it will be appreciated by those skilled in the art that these particular embodiments have been provided for illustrative purposes only and do not represent an exhaustive register of each and every latching mechanism covered by the present invention. Indeed, other types, kinds, versions, and forms of the latching mechanism may alternatively be employed without departing from the scope or spirit of the present invention.

As mentioned briefly above, the interlocking fastening strips of the closure device may also be of virtually any type, kind, version, or form. By way of example, the fastening strips 120, 130, 320, 330 may comprise shear action or Z-axis fastening strips, as shown herein at FIGS. 4–7, 10, and 13–16. As shown in FIG. 16, shear action closure strips include a first web 324 and a complementary second web 334 which occlude upon moving the slider member 350 in the occlusion direction 351.

Figure 17:
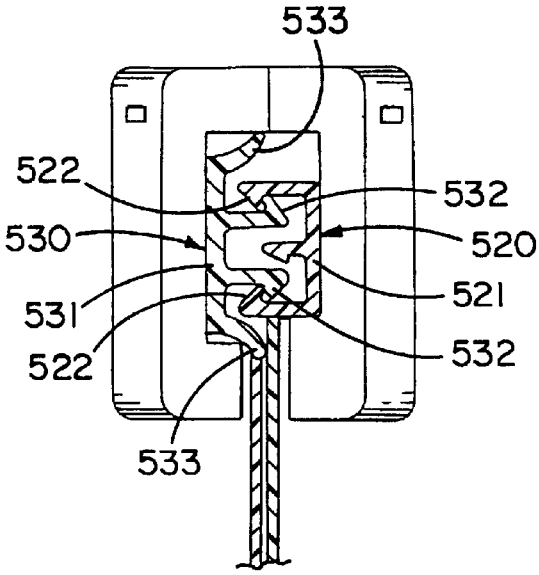
FIG. 17 is a cross-sectional view taken along line 17—17 in FIG. 2, but showing a second embodiment of the interlocking fastening strips.

The interlocking fastening strips may comprise U-channel fastening strips, as shown in FIG. 17. U-channel fastening strips 520, 530 include a female element 521 which interlockingly receives a male element 531. As shown in FIG. 17, the male element 531 includes a pair of inner hook portions 532 and a pair of outer wings 533. The female element 521 includes a pair of hook portions 522 which are adapted to interlockingly engage the hook portions 532 of the male element 531.

In addition, the interlocking fastening strips may comprise arrowhead-type fastening strips, as shown in FIG. 18. As described more fully in U.S. Pat. Nos. 3,198,228 (which reissued as Re. 28,969), 4,736,496, and 5,363,540, arrowhead-type fastening strips 620, 630 include an outer female, web 626 with a C-shaped engagement portion 627 and an inner male web 636 with an arrowhead-shaped engagement portion 637. In use, the inner male web 636 and the outer female web 626 are selectively occluded and deoccluded by moving the slider member 650 in the appropriate direction. The deocclusion action is facilitated by a separator finger 654 which projects downwardly between the inner male web 636 and the outer female web 626.

The interlocking fastening strips may comprise rolling action fastening strips, as shown, for example, in FIG. 19. Rolling action fastening strips 720, 730 include profile elements 738 and 728. In another embodiment, a separator finger 754 may be used to deocclude the fastening strips.

Figure 20:
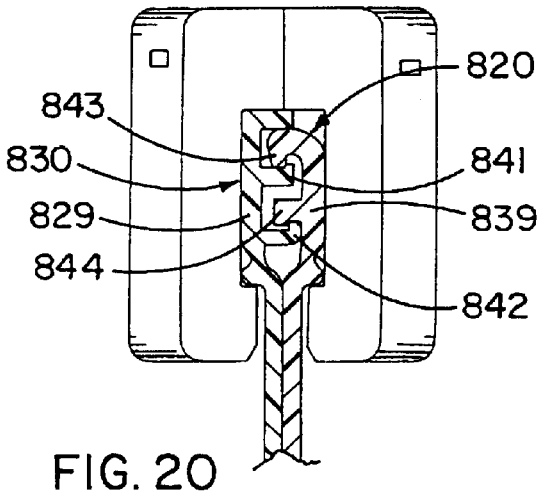
FIG. 20 is a cross-sectional view taken along line 20—20 in FIG. 2, but showing a fifth embodiment of the interlocking fastening strips.

The interlocking fastening strips may comprise profile fastening strips, as shown in FIG. 20. As described more fully in U.S. Pat. No. 5,664,299, profile fastening strips 820, 830 include a first profile 829 having uppermost and bottommost closure elements 841 and 842, respectively, and a second profile 839 having corresponding uppermost and bottommost closure elements 843 and 844, respectively. Infuse, the uppermost and bottommost closure elements of the first and second profiles 829 and 839 are selectively occluded and deoccluded by moving the slider member 850 in the appropriate direction.

It will be readily appreciated by those skilled in the art that the embodiments of the inventive latching mechanism may be employed with these and other types of fastening strips, including those shown in FIGS. 17–20, without departing from the scope or spirit of the present invention.

The slider can be colored, opaque or clear. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene).

The interlocking fastening strips may be manufactured by extrusion through a die. In addition, the fastening strips may be manufactured to have approximately uniform cross-sections. This not only simplifies the manufacturing of a closure device, but also contributes to the physical flexibility of the closure device, which may be a desirable property.

Generally, the interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to form the fastening strips. In most instances, the fastening strips are preferably made from low density polyethylene. The selection of the appropriate thermoplastic material, however, is related to the particular design of the fastening strips, the Young's Modulus of the thermoplastic material, and the desired elasticity and flexibility of the strips.

When the interlocking fastening strips are used in a sealable bag, the fastening strips and the films that form the side walls of the bag may be conveniently manufactured from heat sealable material. In this way, the bag may be economically formed by using an aforementioned thermoplastic material and by heat sealing the fastening strips to the bag. In most instances, the bag is preferably made from a mixture of high pressure, low density polyethylene and linear, low density polyethylene.

The interlocking fastening strips may be manufactured by extrusion or other known methods. For example, the closure device may be manufactured as individual fastening strips for later attachment to the side walls of the bag or may be manufactured integrally therewith. In addition, the fastening strips may be manufactured with or without flange portions on one or both of the fastening strips depending upon the interned use of the closure device or expected additional manufacturing operations.

Generally, the closure device can be manufactured in a variety of forms to suit the intended use. The closure device may be integrally formed on the opposing side walls of the container or bag, or connected to the container by way of any known method. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

In summary, the present invention provides a multi-piece slider member for use with a closure device having interlocking fastening strips disposed along opposing side walls of a storage container, such as a conventional plastic bag. The slider member comprises a first housing segment, a separate second housing segment, and a latching mechanism for use in assembling the first and second housing segments together onto the fastening strips. The latching mechanism includes a first member disposed on the first housing segment and a cooperating second member disposed on the second housing segment. The first and second members of the latching mechanism each have a shoulder with an edge portion. When the first and second housing segments are moved together during assembly, the second member of the latching mechanism receives the first member of the latching mechanism. The edge portion of the first member engages the edge portion of the second member to hold the first and second housing segments together in an assembled position.

While the present invention has been described and disclosed in connection with certain illustrated embodiments, it will be understood, of course, that there is no intention to limit the invention to the disclosed structural forms. On the contrary, the intention is to cover to cover all modifications, alternative constructions, and equivalents that fall within the scope and spirit of the present invention as defined by the following claims. In addition, all references and co-pending applications cited herein are hereby incorporated by reference in their entireties.

What is claimed is:

1. A closure device comprising:

interlocking fastening strips; and a slider member slidably disposed on the interlocking fastening strips, the slider member facilitating occlusion of said fastening strips when moved towards a first end thereof and facilitating deocclusion of said fastening strips when moved towards a second end thereof, the slider member including a first housing segment, a separate second housing segment, and a latching mechanism comprising a first member disposed on the first housing segment and a cooperating second member disposed on the second housing segment, the first and second members each having a shoulder with an edge portion, the second member of the latching mechanism receiving the first member of the latching mechanism when the first and second housing segments are moved together while the edge portion of the first member engages the edge portion of the second member to hold the first and second housing segments together in an assembled position upon the interlocking fastening strips wherein the first and second housing segments each have a top portion, a side portion, and a bottom portion, the top portions of the first and second housing segments each having an opposing face, and wherein the first member of the latching mechanism has a partially planar configuration and projects outwardly from the top portion of the first housing segment.

2. The invention set forth in claim 1, wherein the face of the first housing segment abuts the face of the second housing segment when the first and second housing segments are in the assembled position.

3. The invention set forth in claim 1, wherein the first and second members of the latching mechanism are resilient.

4. The invention set forth in claim 1, wherein the second member of the latching mechanism has a partially planar configuration and projects outwardly from the top portion of the second housing segment.

5. The invention set forth in claim 1, wherein the first member of the latching mechanism is offset from but substantially parallel to the second member of the latching mechanism when the first and second housing segments are in the assembled position.

6. The invention set forth in claim 1, wherein the first and second members of the latching mechanism are adapted to flex when the first and second housing segments are moved toward the assembled position.

7. The invention set forth in claim 1, wherein the interlocking fastening strips comprise U-channel type fastening strips.

8. The invention set forth in claim 1, wherein the interlocking fastening strips comprise shear action fastening strips.

9. The invention set forth in claim 1, wherein the interlocking fastening strips comprise arrowhead-type fastening strips.

10. The invention set forth in claim 1, wherein the interlocking fastening strips comprise rolling action fastening strips.

11. The invention set forth in claim 1, wherein the interlocking fastening strips comprise profile fastening strips.

12. The invention set forth in claim 1, wherein the first member of the latching mechanism is disposed adjacent to a first aperture formed in the top portion of the first housing segment and the second member of the latching mechanism is disposed adjacent to a second aperture formed in the top portion of the second housing segment.

13. The invention set forth in claim 12, wherein said top portion of the first housing segment includes a third aperture, said first aperture is disposed on one side of the first member, said third aperture is disposed on the opposite side of the first member, said top portion of the second housing segment includes a fourth aperture, said second aperture is disposed on one side of the second member, said fourth aperture is disposed on the opposite side of the second member.

14. The invention set forth in claim 12, wherein said first and second apertures formed in the top portions of the first and second housing segments each project inwardly from the faces thereof.

15. The invention set forth in claim 14, wherein said first and second apertures formed in the top portions of the first and second housing segments each have a chamfer at the fates thereof.

16. The invention set forth in claim 15, wherein the shoulder of the first member is disposed at a distal end of the first member and the shoulder of the second member is disposed at a distal end of the second member.

17. The invention set forth in claim 16, wherein the shoulders of the first and second members each have an inclined camming surface.

18. The invention set forth in claim 17, wherein the inclined camming surface of the first member is adapted to engage the inclined camming surface of the second member when the first and second housing segments are moved toward the assembled position.

19. The invention set forth in claim 15, wherein the shoulder of the first member is received by said second aperture formed in the top portion of the second housing segment and is proximate to the chamfer thereof when the first and second housing segments are in the assembled position.

20. The invention set forth in claim 15, wherein the shoulder of the second member is received by said first aperture formed in the top portion of the first housing segment and is proximate to the chamfer thereof when the first and second housing segments are in the assembled position.

21. The invention set forth in claim 1, wherein a first aperture is formed in the top portion of the second housing segment.

22. The invention set forth in claim 21, wherein the shoulder of the second member is disposed adjacent to said first aperture formed in the top portion of the second housing segment.

23. The invention set forth in claim 22, wherein the shoulder of the first member is disposed at a distal end of the first member.

24. The invention set forth in claim 23, wherein the shoulder of the first member includes an inclined camming surface.

25. The invention set forth in claim 24, wherein the inclined camming surface of the first member engages the shoulder of the second member when the first and second housing segments are moved toward the assembled position.

26. The invention set forth in claim 25, wherein the first member flexes away from the shoulder of the second housing segment and into said first aperture formed in the top portion of the second housing segment when the first and second housing segments are moved toward the assembled position.

27. A closure device comprising:

interlocking fastening strips; and a slider member slidably disposed on the interlocking fastening strips, the slider member facilitating occlusion of said fastening strips when moved towards a first end thereof and facilitating deocclusion of said fastening strips when moved towards a second end thereof, the slider member including a first housing segment, a separate second housing segment, and a latching mechanism comprising a first member disposed on the first housing segment and a cooperating second member disposed on the second housing segment, the first and second members each having a shoulder with an edge portion, the second member of the latching mechanism receiving the first member of the latching mechanism when the first and second housing segments are moved together while the edge portion of the first member engages the edge portion of the second member to hold the first and second housing segments together in an assembled position upon the interlocking fastening strips a first alignment pin projecting outwardly from the top portion of the first housing segment; and a first cooperating slot formed in the top portion of the second housing segment.

28. The invention set forth in claim 27, wherein said first cooperating slot receives said first alignment pin when the first and second housing segments are moved toward the assembled position.

29. The invention set forth in claim 27, further comprising second alignment pin and a second cooperating slot.

30. The invention set forth in claim 27, wherein the interlocking fastening strips comprise U-channel type fastening strips.

31. The invention set forth in claim 27, wherein the interlocking fastening strips comprise shear action fastening strips.

32. The invention set forth in claim 27, wherein the interlocking fastening strips comprise arrowhead-type fastening strips.

33. The invention set forth in claim 27, wherein the interlocking fastening strips comprise rolling action fastening strips.

34. The invention set forth in claim 27, wherein the interlocking fastening strips comprise profile fastening strips.

35. A storage container comprising:

first and second side walls including a first fastening strip and a second fastening strip respectively, said first and second fastening strips arranged to be interlocked over a predetermined length; and a slider member slidably disposed on the first and second fastening strips for facilitating occlusion of said fastening strips when moved towards a first end thereof and for facilitating deocclusion of said fastening strips when moved towards a second end thereof, the slider member including a first housing segment, a separate second housing segment, and a latching mechanism comprising a first member disposed on the first housing segment and a cooperating second member disposed on the second housing segment, the first and second members each having a shoulder with an edge portion, the second member of the latching mechanism receiving the first member of the latching mechanism when the first and second housing segments are moved together while the edge portion of the first member engages the edge portion of the second member to hold the first and second housing segments together in an assembled position upon the fastening strips wherein the first and second housing segments each have a top portion, a side portion, and a bottom portion, the top portions of the first and second housing segments each having an opposing face and wherein the first member of the latching mechanism has a partially planar configuration and projects outwardly from the top portion of the first housing segment.

36. The invention set forth in claim 35, wherein the face of the first housing segment abuts the face of the second housing segment when the first and second housing segments are in the assembled position.

37. The invention set forth in claim 35, wherein the first and second members of the latching mechanism are resilient.

38. The invention set forth in claim 35, wherein the second member of the latching mechanism has a partially planar configuration and projects outwardly from the top portion of the second housing segment.

39. The invention set forth in claim 35, wherein the first member of the latching mechanism is offset from but substantially parallel to the second member of the latching mechanism when the first and second housing segments are in the assembled position.

40. The invention set forth in claim 35, wherein the first and second members of the latching mechanism are adapted to flex when the first and second housing segments are moved toward the assembled position.

41. The invention set forth in claim 35, wherein the interlocking fastening strips comprise U-channel type fastening strips.

42. The invention set forth in claim 35, wherein the interlocking fastening strips comprise shear action fastening strips.

43. The invention set forth in claim 35, wherein the interlocking fastening strips comprise arrowhead-type fastening strips.

44. The invention set forth in claim 35, wherein the interlocking fastening strips comprise rolling action fastening strips.

45. The invention set forth in claim 35, wherein the interlocking fastening strips comprise profile fastening strips.

46. The invention set forth in claim 35, wherein the first member of the latching mechanism is disposed adjacent to a first aperture formed in the top portion of the first housing segment and the second member of the latching mechanism is disposed adjacent to a second aperture formed in the top portion of the second housing segment.

47. The invention set forth in claim 46, wherein said top portion of the first housing segment includes a third aperture, said first aperture is disposed on one side of the first member, said third aperture is disposed on the opposite side of the first member, said top portion of the second housing segment includes a fourth aperture, said second aperture is disposed on one side of the second member, said fourth aperture is disposed on the opposite side of the second member.

48. The invention set forth in claim 46, wherein said first and second apertures formed in the top portions of the first and second housing segments each project inwardly from the faces thereof.

49. The invention set forth in claim 48, wherein said first and second apertures formed in the top portions of the first and second housing segments each have a chamfer at the faces thereof.

50. The invention set forth in claim 49, wherein the shoulder of the first member is disposed at a distal end of the first member and the shoulder of the second member is disposed at a distal end of the second member.

51. The invention set forth in claim 50, wherein the shoulders of the first and second members each have an inclined camming surface.

52. The invention set forth in claim 51, wherein the inclined camming surface of the first member is adapted to engage the inclined camming surface of the second member when the first and second housing segments are moved toward the assembled position.

53. The invention set forth in claim 49, wherein the shoulder of the first member is received by said second aperture formed in the top portion of the second housing segment and is proximate to the chamfer thereof when the first and second housing segments are in the assembled position.

54. The invention set forth in claim 49, wherein the shoulder of the second member is received by said first aperture formed in the top portion of the first housing segment and is proximate to the chamfer thereof when the first and second housing segments are in the assembled position.

55. The invention set forth in claim 35, wherein a first aperture is formed in the top portion of the second housing segment.

56. The invention set forth in claim 55, wherein the shoulder of the second member is disposed adjacent to said first aperture formed in the top portion of the second housing segment.

57. The invention set forth in claim 56, wherein the shoulder of the first member is disposed at a distal end of the first member.

58. The invention set forth in claim 57, wherein the shoulder of the first member includes an inclined camming surface.

59. The invention set forth in claim 58, wherein the inclined camming surface of the first member engages the shoulder of the second member when the first and second housing segments are moved toward the assembled position.

60. The invention set forth in claim 59, wherein the first member flexes away from the shoulder of the second housing segment and into said first aperture formed in the top portion of the second housing segment when the first and second housing segments are moved toward the assembled position.

61. A storage container comprising:

first and second side walls including a first fastening strip and a second fastening strip respectively, said first and second fastening strips arranged to be interlocked over a predetermined length;

a slider member slidably disposed on the first and second fastening strips for facilitating occlusion of said fastening strips when moved towards a first end thereof and for facilitating deocclusion of said fastening strips when moved towards a second end thereof, the slider member including a first housing segment, a separate second housing segment, and a latching mechanism comprising a first member disposed on the first housing segment and a cooperating second member disposed on the second housing segment, the first and second members each having a shoulder with an edge portion, the second member of the latching mechanism receiving the first member of the latching mechanism when the first and second housing segments are moved together while the edge portion of the first member engages the edge portion of the second member to hold the first and second housing segments together in an assembled position upon the fastening strips;

a first alignment pin projecting outwardly from the top portion of the first housing segment; and a first cooperating slot formed in the top portion of the second housing segment.

62. The invention set forth in claim 61, wherein said first cooperating slot receives said first alignment pin when the first and second housing segments are moved toward the assembled position.

63. The invention set forth in claim 61, further comprising a second alignment pin and a second cooperating slot.

64. The invention set forth in claim 61, wherein the interlocking fastening strips comprise U-channel type fastening strips.

65. The invention set forth in claim 61, wherein the interlocking fastening strips comprise shear action fastening strips.

66. The invention set forth in claim 61, wherein the interlocking fastening strips comprise arrowhead-type fastening strips.

67. The invention set forth in claim 61, wherein the interlocking fastening strips comprise rolling action fastening strips.

68. The invention set forth in claim 61, wherein the interlocking fastening strips comprise profile fastening strips.

69. A slider member adapted to facilitate the occlusion and deocclusion of interlocking fastening strips, the slider member comprising:

a first housing segment;

a separate second housing segment; and a latching mechanism comprising a first member disposed on the first housing segment and a cooperating second member disposed on the second housing segment, the first and second members each having a shoulder with an edge portion, the second member of the latching mechanism receiving the first member of the latching mechanism when the first and second housing segments are moved together while the edge portion of the first member engages the edge portion of the second member to hold the first and second housing segments together in an assembled position wherein the first and second housing segments each has a top portion, a side portion, and a bottom portion, and top portions of the first and second housing segments each having an opposing face and wherein the first member of the latching mechanism has a partially planar configuration and projects outwardly from the top portion of the first housing segment.

70. The invention set forth in claim 69, wherein the face of the first housing segment abuts the face of the second housing segment when the first and second housing segments are in the assembled position.

71. The invention set forth in claim 69, wherein the first and second members of the latching mechanism are resilient.

72. The invention set forth in claim 69, wherein the second member of the latching mechanism has a partially planar configuration and projects outwardly from the top portion of the second housing segment.

73. The invention set forth in claim 69, wherein the first member of the latching mechanism is offset from but substantially parallel to the second member of the latching mechanism when the first and second housing segments are in the assembled position.

74. The invention set forth in claim 69, wherein the first and second members of the latching mechanism are adapted to flex when the first and second housing segments are moved toward the assembled position.

75. The invention set forth in claim 69, wherein the first member of the latching mechanism is disposed adjacent to a first aperture formed in the top portion of the first housing segment and the second member of the latching mechanism is disposed adjacent to a second aperture formed in the top portion of the second housing segment.

76. The invention set forth in claim 75, wherein said top portion of the first housing segment includes a third aperture, said first aperture is disposed on one side of the first member, said third aperture is disposed on the opposite side of the first member, said top portion of the second housing segment includes a fourth aperture, said second aperture is disposed on one side of the second member, said fourth aperture is disposed on the opposite side of the second member.

77. The invention set forth in claim 75, wherein said first and second apertures formed in the top portions of the first and second housing segments each project inwardly from the faces thereof.

78. The invention set forth in claim 77, wherein said first and second apertures formed in the top portions of the first and second housing segments each have a chamfer at the faces thereof.

79. The invention set forth in claim 78, wherein the shoulder of the first member is disposed at a distal end of the first member and the shoulder of the second member is disposed at a distal end of the second member.

80. The invention set forth in claim 79, wherein the shoulders of the first and second members each have an inclined camming surface.

81. The invention set forth in claim 80, wherein the inclined camming surface of the first member is adapted to engage the inclined camming surface of the second member when the first and second housing segments are moved toward the assembled position.

82. The invention set forth in claim 78, wherein the shoulder of the first member is received by said second aperture formed in the top portion of the second housing segment and is proximate to the chamfer thereof when the first and second housing segments are in the assembled position.

83. The invention set forth in claim 78, wherein the shoulder of the second member is received by said first aperture formed in the top portion of the first housing segment and is proximate to the chamfer thereof when the first and second housing segments are in the assembled position.

84. The invention set forth in claim 69, wherein a first aperture is formed in the top portion of the second housing segment.

85. The invention set forth in claim 84, wherein the shoulder of the second member is disposed adjacent to said first aperture formed in the top portion of the second housing segment.

86. The invention set forth in claim 85, wherein the shoulder of the first member is disposed at a distal end of the first member.

87. The invention set forth in claim 86, wherein the shoulder of the first member includes an inclined camming surface.

88. The invention set forth in claim 87, wherein the inclined camming surface of the first member engages the shoulder of the second member when the first and second housing segments are moved toward the assembled position.

89. The invention set forth in claim 88, wherein the first member flexes away from the shoulder of the second housing segment and into said first aperture formed in the top portion of the second housing segment when the first and second housing segments are moved toward the assembled position.

90. A slider member adapted to facilitate the occlusion and deocclusion of interlocking fastening strips, the slider member comprising:

a first housing segment;

a separate second housing segment;

a latching mechanism comprising a first member disposed on the first housing segment and a cooperating second member disposed on the second housing segment, the first and pond members each having a shoulder with an edge portion, the second member of the latching mechanism receiving the first member of the latching mechanism when the first and second housing segments are moved together while the edge portion of the first member engages the edge portion of the second member to hold the first and second housing segments together in an assembled position a first alignment pin projecting outwardly from the top portion of the first housing segment; and a first cooperating slot formed in the top portion of the second housing segment.

91. The invention set forth in claim 90, wherein said first cooperating slot receives said first alignment pin when the first and second housing segments are moved toward the assembled position.

92. The invention set forth in claim 90, further comprising a second alignment pin and a second cooperating slot.

93. A method for manufacturing a closure device comprising the steps of;

providing interlocking fastening strips;

providing a slider member including a first housing segment, a separate second housing segment, and a latching mechanism comprising a first member disposed on the first housing segment and a cooperating second member disposed on the second housing segment, the first and second members each having a shoulder with an edge portion;

positioning the first housing segment and the second housing segment in proximity to the fastening strips; and moving the first housing segment and the second housing segment together, the second member of the latching mechanism receiving the first member of the latching mechanism when the first and second housing segments are moved together while the edge portion of the first member engages the edge portion of the second member to hold the first and second housing segments together in an assembled position upon the interlocking fastening strips, the assembled slider member slidably disposed on the interlocking fastening strips, the assembled slider member facilitating occlusion of said fastening strips when moved towards a first end thereof and facilitating deocclusion of said fastening strips when moved towards a second end thereof, wherein the first and second housing segments each has a top portion, a side portion, and a bottom portion, the top portions of the first and second housing segments each having an opposing face, the face of the first housing segment abuts the face of the second housing segment when the first and second housing segments are in the assembled position, and wherein the first member of the latching mechanism has a partially planar configuration and projects outwardly from the top portion of the first housing segment.

94. A method for manufacturing a closure device comprising the steps of:

providing interlocking fastening strips;

providing a slider member including a first housing segment, a separate second housing segment, and a latching mechanism comprising a first member disposed on the first housing segment and a cooperating second member disposed on the second housing segment, the first and second members each having a shoulder with an edge portion;

positioning the first housing segment and the second housing segment in proximity to the fastening strips;

strips moving the first housing segment and the second housing segment together, the second member of the latching mechanism receiving the first member of the latching mechanism when the first and second housing segments are moved together while the edge portion of the first member engages the edge portion of the second member to hold the first and second housing segments together in an assembled position upon the interlocking fastening strips, the assembled slider member slidably disposed on the interlocking fastening strips, the assembled slider member facilitating occlusion of said fastening strips when moved towards a first end thereof and facilitating deocclusion of said fastening strips when moved towards a second end thereof wherein a first alignment pin projects outwardly from the top portion of the first housing segment; and a first cooperating slot is formed in the top portion of the second housing segment.

95. The invention set forth in claim 94, wherein said first cooperating slot receives said first alignment pin when the first and second housing segments are moved toward the assembled position.

96. The invention set forth in claim 94, further comprising a second alignment pin and a second cooperating slot.

* * * * *